United States Patent [19]

Ban

[11] Patent Number: 4,586,765

[45] Date of Patent: May 6, 1986

[54] SAFETY COVER FOR AN ELECTRICAL OUTLET

[76] Inventor: Thomas E. Ban, 1156 Berwick La., South Euclid, Ohio 44121

[21] Appl. No.: 641,294

[22] Filed: Aug. 16, 1984

[51] Int. Cl.[4] ..... H01R 13/44

[52] U.S. Cl. ..... 339/44 R; 339/36

[58] Field of Search ..... 339/44 R, 44 M, 39

[56] References Cited

U.S. PATENT DOCUMENTS 4,070,078 1/1978 Chrones ..... 339/44 R

*Primary Examiner*—Gil Weidenfeld
*Assistant Examiner*—Paula A. Austin
*Attorney, Agent, or Firm*—Harlan E. Hummer

[57] ABSTRACT

A safety cover for a duplex electrical outlet is described as having (i) an inner plate which is secured to the outlet, and (ii) an outer plate which is detachably hinged to the inner plate so that electrical plugs with metal prongs can be easily inserted into the outlets and removed therefrom as the outer plate is rotated from the inner plate. Further, the outer plate is completely removable from the inner plate as a safety feature so that tripping over an electrical cord, extending from the safety cover, is practically impossible because of this quick release feature of the safety cover. The inner and outer plates are uniquely hinged together by a hinge that is secured to one of the plates while being releasably joined to the other of the plates. The outer plate is designed to accommodate a conventional electrical plug. Further, the outer plate is provided with a special slot through which an electrical cord, attached to the plug, passes exteriorly of the cover.

13 Claims, 7 Drawing Figures

SAFETY COVER FOR AN ELECTRICAL OUTLET

BACKGROUND OF INVENTION

The invention relates to electrical safety devices, especially those which are used in connection with a single or duplex electrical outlet and which permit the use of such outlets while preventing children from getting an electrical shock when playing around the outlets.

U.S. Pat. Nos. 2,880,264 and 4,070,078 disclose typical safety devises which are used to protect children from duplex electrical outlets and which rely on a cover that is hinged to the cover plate of the outlet. A big problem with such devices is that they will not readily release from the outlet should someone accidently strike or trip over the electrical cord that is attached to the plug held within the device. The invention is directed to a protective cover which provides ready access to the outlet and quick release from the outlet in case of an accident.

SUMMARY OF INVENTION

Briefly stated, the invention is in a safety device for covering a single or duplex electrical outlet while permitting easy access to the outlet. The device comprises an inner plate which is secured to the outlet and exposes the outlet for use, and an outer plate which is in juxtaposed, covering relation with the inner plate. The outer plate has an open end slot through which an electrical cord, attached to a plug mounted in the outlet, passes. Means are provided for detachably hinging the outer plate to the inner plate for rotation about the marginal edge of the outer plate opposite the marginal edge thereof through which the slot extends. Further, means are supplied for releaseably holding the slotted end of the outer plate adjacent the inner plate so that the outer plate, when required, can be rotated out of interferring relation with the placement or removal of a plug from the electrical outlet.

BRIEF DESCRIPTION OF DRAWING

The following description of the invention will be better understood by having reference to the accompanying drawing, wherein.

DESCRIPTION OF INVENTION

Figure 3:
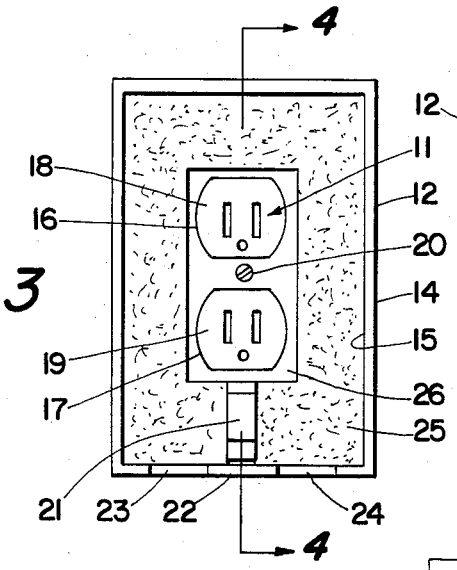
FIG. 3 is a front view of the inner plate of the device.
Figure 4:
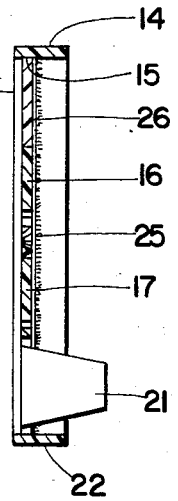
FIG. 4 is a section of the inner plate viewed from the line 4—4 of FIG. 3.

With general reference to the drawing, there is shown a safety cover 10 for a conventional duplex electrical outlet 11. The safety cover, for descriptive purposes, is shown in a vertical position and comprises a lower or inner plate 12 which is rectanguler, in shape, and which is closest the duplex outlet 11, and an upper or outer plate 13 which is in juxtaposed covering relation with the inner plate 12. The inner plate 12 (FIGS. 3 and 4), is flat, except for an outstanding flange 14 which extends around the outer periphery 15 of the plate 12 which has two openings 16, 17 for matingly receiving the two plug outlets 18, 19. The inner plate 12 is conventionally mounted on the duplex outlet 11 by means of a small machine screw 20. A thumb rest 21 of any suitable shape, projects outwardly from the plane of the inner plate 12 between the bottom outlet opening 17 and the vertically lowermost outer flange portion 22 which is provided with two finger openings or cut-outs 23,24 adjacent the thumb rest 21. A strip fastener, e.g. the loop portion 25 of a hook and loop fastener such as manufactured and sold by the Velcro Corporation under their trademark Velcro, is secured to the outer exposed face 26 of the inner plate 12 adjacent the outer peripheral flange 14, as best seen in FIG. 3.

Figure 1:
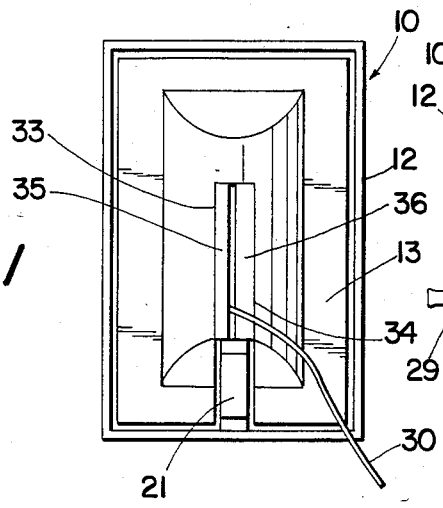
FIG. 1 is a front view of a safety device which is made in accordance with the invention for covering and protecting a duplex electrical outlet.
Figure 2:
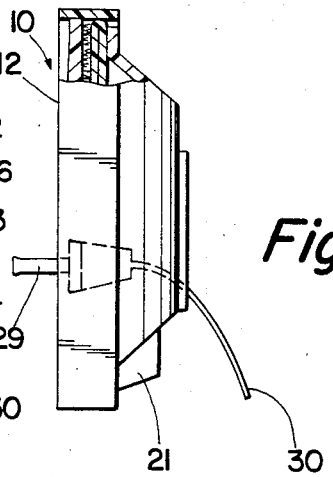
FIG. 2 is a side view of the device.
Figure 5:
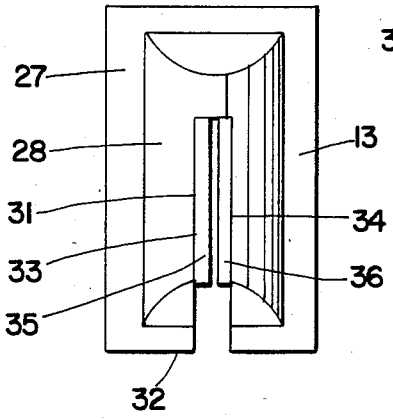
FIG. 5 is a front view of the outer plate of the device.
Figure 6:
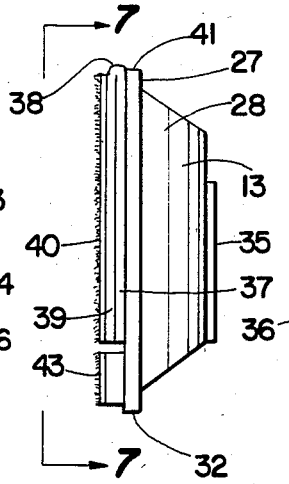
FIG. 6 is a side view of the outer plate.
Figure 7:
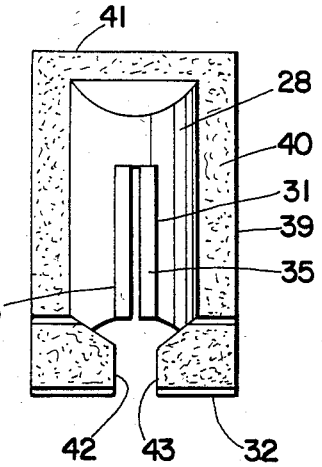
FIG. 7 is a view of the underside of the outer plate as seen from the line 7—7 of FIG. 6.

The outer plate 13 (FIGS. 5–7) has a flat, outer rectangular frame 27 between which a hanger-shaped housing 28 projects outwardly from the inner plate 12. The housing 28 is adequately raised to accommodate a conventional plug 29 at the end of a cord 30 which is connected to an electrical appliance, such as a vacuum cleaner, not shown. The housing 28 has a vertically extending slot 31 which extends through the bottom portion 32 of the frame 27 in line with the thumb rest 21, as best seen in FIG. 1. The opposing, longitudinally extending sides 33,34 of the slot 31, in the area of the housing 28, are lined with soft, pliable lips or strips 35,36 of polyvinyl chloride plastic to protect the cord 30 against any damage from rubbing against the more rigid housing 28.

The outer plate 13 is detachably hinged to the inner plate 12 by any suitable means which permits partial detachment of the outer plate 13 to permit relative rotation of the plates and, further, complete detachment of the outer plate 13 from the inner plate 12. For example, the rectangular frame 27 of the outer plate 13 is secured to an inverted, U-shaped leg 37 of a soft, pliable polyvinyl chloride plastic hinge 38. The other inverted U-shaped leg 39 of the hinge 38 is secured to the hook portion 40 of the aforementioned Velcro hook and loop fastener in confronting relation with the loop portion 25 which is secured to the inner plate 12 around the duplex outlet 11. It can be appreciated that the hook portion 40 will become interlocked with the loop portion 25 when the two plates 12,13 are pressed together. It can be seen from the drawing that the outer plate 13 is hinged to the inner plate 12 to rotate about what is essentially the top marginal edge 41 of the outer frame 27. The opposing slotted frame portion 32 is provided with two separate built-up hook portions 42,43 which are in planar alignment with the hook portion 40 carried by the hinge 38 and which are designed to releaseably interlock the loop portion 25 adjacent the thumb rest 21.

Assuming it is desired to plug an electric appliance into the duplex outlet 11, when the outer plate 13 is interlocked with the inner plate 12, the thumb of one hand is placed on the thumb rest 21. The two adjacent fingers are slipped into the cut-outs 23,24 to engage and pull out the slotted bottom portion 32 of the frame 27 to disengage the hook portions 42,43 from the adjacent loop portion 25, so that the outer plate 13 can be rotated out of interfering relation with the insertion of an electrical plug, attached to the cord of the appliance, into one of the electrical outlets. The outer plate 13 is then rotated back into interlocking engagement with the inner plate 13. Should someone accidently give the cord a hard jerk, the plug, as it moves outwardly from the outlet, will engage the housing 28 to pull the outer plate 13 from the inner plate 12 a distance sufficient to disengage the hook portions 40,42,43 from the loop portion 25 of the Velcro fastener, providing the force exerted against the electrical cord is sufficiently strong. The outer plate 13 is easily replaced by pressing it back against the inner plate 12, until the hook portions become interlocked with the loop portion.

Thus, there has been described a novel safety cover for a single or duplex electrical outlet. The use of the unique plastic hinge and Velcro-type fastener combination provides an excellent and different mounting for the exterior cover plate which overlays and protects the electrical outlet. The amount of Velcro fastener needed depends on the force desired to separate the inner and outer plates of the safety cover. The inner plate can be made by securing a peripheral flange around a conventional base plate which is normally used to cover a single or duplex electrical outlet.

What is claimed is:

1. A safety cover for an electrical outlet for receiving at least one electrical plug to which an electrical cord is attached, comprising:

(a) an inner plate which is detachably mounted on an electrical outlet, the inner plate having at least one opening for exposing an outlet in which a plug is inserted, the inner plate being sized to cover the electrical outlet;

(b) means for mounting the inner plate on the electrical outlet;

(c) an outer plate for substantially covering the inner plate, the outer plate being in juxtaposed relation with the inner plate and including a housing which projects outwardly from the outer plate and adjacent inner plate and is shaped to receive and protectively cover a plug inserted in the outlet, the housing having an elongated slot which is wider than the electrical cord to which the plug is attached and narrower than the electrical plug, the slot extending through the adjacent marginal edge of the outer plate; and (d) means for releaseably attaching the outer plate to the inner plate in covering relation with the outlet such that, (i) the outer plate can be rotated out of interfering relation with the placement of a plug in the outlet and removal therefrom, and (ii) the outer plate can break away and separate completely from the inner plate to allow the escapement of a plug from the outlet and housing, should the plug be accidently pulled from the outlet.

2. The safety cover of claim 1, wherein the inner and outer plates are rectangular, in shape, and the means for releaseably attaching the outer plate to the inner plate includes, (i) means for hinging the outer plate for rotation about a second marginal edge which is opposite the slotted marginal edge thereof, (ii) means for releaseably holding the hinging means to the inner plate, and (iii) means for releaseably holding the slotted marginal edge to the inner plate.

3. The safety cover of claim 2, wherein the means for releaseably holding the slotted and second marginal edges to the inner plate each include a hook and loop type fastener which comprises a hook portion and a loop portion which releaseably interlock when pressed together and separate when pulled apart.

4. The safety cover of claim 3, wherein the inner plate includes an upstanding peripheral flange which surrounds the outer plate when the two plates are in confronting interlocked relation.

5. The safety cover of claim 4, wherein the means for releaseably holding the slotted marginal edge to the inner plate includes, (i) a thumb rest projecting from the inner plate outwardly through the slot in the housing adjacent the slotted marginal edge of the outer plate, and (ii) openings in the upstanding flange adjacent the slotted marginal edge of the outer plate to permit a person to grab the slotted marginal edge with the tips of two fingers while pressing on the thumb rest with the thumb to force the slotted marginal edge to desengage from the adjacent inner plate.

6. The safety cover of claim 4, which includes a pair of soft pliable lips extending from opposing sides of the slot in the housing for compressively engaging an electrical cord that passes between them.

7. A safety cover for an electrical outlet, comprising:

(a) an inner plate for securement to the outlet, the inner plate having at least one opening which exposes the outlet for use, the inner plate covering the area immediately surrounding the outlet, the inner plate being rectangular, in shape, and flat except for an outstanding flange around the outer periphery of the inner plate;

(b) means for securing the inner plate to the outlet;

(c) an outer plate hinged to the inner plate in juxtaposed at least partially covering relation with the inner plate, the flange of the inner plate surrounding the outer plate when the outer plate is in juxtaposed relation with the inner plate, the outer plate including a housing which projects outwardly from the inner plate and which is designed to receive a conventional plug at the end of an electrical cord, the housing having an elongated slot through which the electrical cord extends from the plug exteriorly from the cover, the slot extending through the adjacent marginal edge of the outer plate;

(d) a relatively soft and pliable hinge composed of polyvinyl chloride plastic, mounting the outer plate for rotation about the marginal edge thereof opposite the slotted marginal edge of the outer plate;

(e) means for detachably mounting the hinge on the inner plate, including a hook and loop-type fastener which comprises a loop portion and a hook portion which releaseably interlock, one of the portions being secured to the hinge in confronting relation with the other of the portions which is secured to the inner plate;

(f) means for securing the hinge to the outer plate; and (g) means coacting between the slotted marginal edge of the outer plate and the adjacent portion of the inner plate for releaseably holding the slotted marginal edge of the outer plate adjacent the inner plate to prevent rotation of the outer plate until the slotted marginal edge is released from adjacent the inner plate.

8. The safety cover of claim 7, wherein the outer plate includes, (i) a flat, outer rectangular frame, and (ii) a raised housing projecting outwardly from between the frame in a direction away from the inner plate, the housing designed to receive an electrical plug, as indicated in claim 1.

9. The safety cover of claim 8, wherein the hinge includes a pair of generally U-shaped legs pivotally joined together, one of the legs being secured to the frame of the outer plate.

10. The safety cover of claim 9, wherein the slot has a pair of opposing marginal edges which, in the area of the housing, are provided with a pair of soft, pliable lips between which an electrical cord is designed to pass, the lips protecting the cord against damage from rubbing against the more rigid housing.

11. A safety cover for an electrical outlet in which a plug, attached to an electrical cord, is inserted, the cover comprising:

(a) an inner plate securable to the outlet, the plate including, (i) a flat portion which is rectangular, in shape, and which has at least one opening that exposes the electrical outlet for use, and which covers the immediate, surrounding area of the outlet, (ii) an outstanding flange bordering the flat portion and extending from the plane of the flat portion, the flange having a pair of spaced cut-outs in the vertically lowermost portion of the flange when the inner plate is properly mounted on a vertically disposed electrical outlet, and (iii) a thumb rest projecting outwardly from the plane of the flat portion adjacent and between the pair of spaced cut-outs;

(b) means for detachably mounting the inner plate on the electrical outlet;

(c) an outer plate hinged to the inner plate in juxtaposed at least partially covering relation with the inner plate, the outer plate including, (i) an outer rectangular frame which is flat and sized to fit within the outstanding flange of the inner plate, and (ii) a housing projecting outwardly from the inner plate between the outer frame of the outer plate, the housing designed to receive a plug which is at the end of an electrical cord, the housing having a vertically elongated slot when the inner and outer plates are mounted as indicated above, the slot extending through the bottom portion of the frame to form a slotted bottom marginal of the outer plate, the slot, in the area of the housing, having a pair of opposing sides which are lined with soft, pliable lips for engaging an electrical cord passing therebetween to prevent damage to the cord, the slot being in alignment with the thumb rest which extends at least through the slotted marginal edge of the outer plate;

(d) a hinge mounting the outer plate for rotation about the marginal edge thereof opposite the slotted marginal edge, the hinge being composed of soft, pliable polyvinyl chloride plastic and having two generally U-shaped legs which are pivotally joined together;

(e) means for securing one of the legs of the hinge to the frame of the outer plate;

(f) means for detachably mounting the other of the legs of the hinge to the inner plate, including a loop and hook type fastener which comprises a loop portion and a hook portion which releaseably interlock, and means for securing one of the fastener portions to the other of the legs of the hinge, and means for securing the other of the fastener portions to the flat portion of the inner plate adjacent the outer flange thereof, the two fastener portions being secured in confronting relation so that they will interlockingly engage when the outer plate is pressed against the inner plate; and (g) means coacting between the inner plate, adjacent the thumb rest, and the outer plate, adjacent the slotted marginal edge, for releaseably holding the slotted marginal edge adjacent the inner plate, whereby the outer plate is kept from rotating until the slotted marginal edge is released from adjacent the inner plate, said releaseable holding means also including a loop and hook type fastener which comprises a loop portion and a hook portion, one of the fastener portions being secured to the outer plate adjacent the slotted marginal edge and the other of the fastener portions being secured to the inner plate adjacent the thumb rest in confronting relation with the fastener portion carried by the outer plate.

12. The safety cover of claim 11, wherein the inner and outer plates are composed of plastic which is rigid compared to the plastic material of the hinge.

13. The safety cover of claim 12, wherein the cover is designed to cover a duplex electrical outlet, the inner plate being provided with two openings to receive and expose the two outlets of the duplex outlet.

* * * * *